US010604218B2

(12) United States Patent
Vaz et al.

(10) Patent No.: US 10,604,218 B2
(45) Date of Patent: Mar. 31, 2020

(54) MANOEUVRING DEVICE AND METHOD THEROF

(71) Applicant: TOW-BOTIC SYSTEMS PRIVATE LIMITED, Maharashtra (IN)

(72) Inventors: Gary Vaz, Maharashtra (IN); Eric Holohan, Dublin (IE)

(73) Assignee: TOW-BOTIC SYSTEMS PRIVATE LIMITED, Mumbai (IN)

( * ) Notice: Subject to any disclaimer, the term of this patent is extended or adjusted under 35 U.S.C. 154(b) by 61 days.

(21) Appl. No.: 15/760,727

(22) PCT Filed: Sep. 15, 2016

(86) PCT No.: PCT/IN2016/050309

§ 371 (c)(1),
(2) Date: Mar. 16, 2018

(87) PCT Pub. No.: WO2017/056105

PCT Pub. Date: Apr. 6, 2017

(65) Prior Publication Data

US 2019/0202532 A1 Jul. 4, 2019

(30) Foreign Application Priority Data

Oct. 1, 2015 (IN) ..... 3735/MUM/2015

(51) Int. Cl.

| | |
|---|---|
| ***B63B 21/56*** | (2006.01) |
| ***B63B 35/66*** | (2006.01) |
| ***B63B 35/70*** | (2006.01) |
| *B63B 35/00* | (2020.01) |
| *B63H 5/125* | (2006.01) |
| *B63H 25/46* | (2006.01) |

(52) U.S. Cl.

CPC ..... *B63B 35/665* (2013.01); *B63B 35/70* (2013.01); *B63B 2035/008* (2013.01); *B63H 2005/1258* (2013.01); *B63H 2025/465* (2013.01)

(58) Field of Classification Search

CPC ..... B63B 35/66; B63B 35/665; B63B 35/68; B63B 35/70

See application file for complete search history.

(56) References Cited

U.S. PATENT DOCUMENTS

2004/0237870 A1* 12/2004 Clarke ..... B63B 25/006 114/259
2008/0070456 A1* 3/2008 Olsen ..... B63B 22/02 441/3

* cited by examiner

*Primary Examiner* — Andrew Polay
(74) *Attorney, Agent, or Firm* — Leber IP Law; David C. Robertson

(57) ABSTRACT

The present invention provides a remote-controllable underwater device for manoeuvring a vessel. The device comprising at least one housing, a connection unit provided on the housing for rigidly attaching below the water to the vessel to be manoeuvred, at least one propeller mounted on the housing for moving the device and the vessel attached to the connection unit, an antenna for communication with the device from a remote control unit, at least one sensor for path tracking and positioning of the device and the vessel, and a power source for providing power to the connection unit, the propeller, the antenna, and the sensor.

13 Claims, 9 Drawing Sheets

MANOEUVRING DEVICE AND METHOD THEROF

RELATED APPLICATIONS

This application is a national phase entry of International Patent Application No. PCT/IN2016/050309, filed Sep. 15, 2016, which claims the benefit under 35 U.S.C. § 119(b) to Indian Patent Application No. 3735/MUM/2015, filed Oct. 1, 2015, the entire contents of which are hereby incorporated by reference.

FIELD OF THE INVENTION

The present invention relates to an underwater manoeuvring device, more particularly, to a remote controlled underwater device for manoeuvring and positioning of ships, offshore floating vessels and method thereof.

BACKGROUND OF THE INVENTION

The majority of international trade for import and export of goods is carried out by the shipping industry, making it one of the most essential transportation means in carrying out trade. Therefore, manoeuvring of ships and other floating vessels in harbour/port is one of the critical aspects and require pilot of high quality ship-handling and navigational skill to properly navigate the ship and avoid accidents at/or near the harbour/port. Hence, tugboats are used for manoeuvring of ships and other heavy weight transportation in harbour/port for safe control in restricted waters, to wage, and proper positioning.

However, the process becomes cumbersome resulting in delayed positioning. In addition, tugboats incur high manpower cost for operation.

Hence there is a need of means for manoeuvring of ships or other floating vessels i n harbour/port.

SUMMARY OF THE INVENTION

Accordingly, the present invention provides a remote-controllable underwater device for manoeuvring a vessel, a system for manoeuvring a vessel, and a method for manoeuvring a vessel.

In one embodiment, the present invention provides a remote-controllable underwater device for manoeuvring a vessel. The device comprising a housing, a connection unit provided on the housing for rigidly attaching under water to one of sides of the vessel to be manoeuvred, at least one propeller mounted on the housing for moving the vessel attached to the connection unit, an antenna for communication with the device from a remote control unit, at least one sensor for path tracking and positioning of the device and the vessel, and a power source for providing power to the connection unit, the propeller, the antenna, and the sensor.

In second embodiment, the present invention provides a system for manoeuvring a vessel, the system comprising at least one remote-controllable underwater device for manoeuvring the vessel, and a remote control unit for control and monitoring of the device and for manoeuvring the vessel, the controlling and monitoring includes moving the device in proximity to the vessel; attaching the device to the vessel through a connection unit of the device; positioning the vessel to the desired location based on the input received.

In third embodiment, the present invention provides a method for manoeuvring a vessel, the method including the steps of guiding a remote-controllable underwater device, through a remote control unit, in proximity of an external object to be manoeuvred, attaching the device, through a connection unit, to the external object, providing enough thrust, through propeller, to push or pull the external object in required direction, and positioning the external object by the device according to the instructions received from the remote control unit.

BRIEF DESCRIPTION OF DRAWINGS

Reference will be made to embodiments of the invention, example of which may be illustrated in the accompanying figure(s). These figure(s) are intended to be illustrative, not limiting. Although the invention is generally described in the context of these embodiments, it should be understood that it is not intended to limit the scope of the invention to these particular embodiments.

DESCRIPTION OF THE INVENTION

Figure 1:
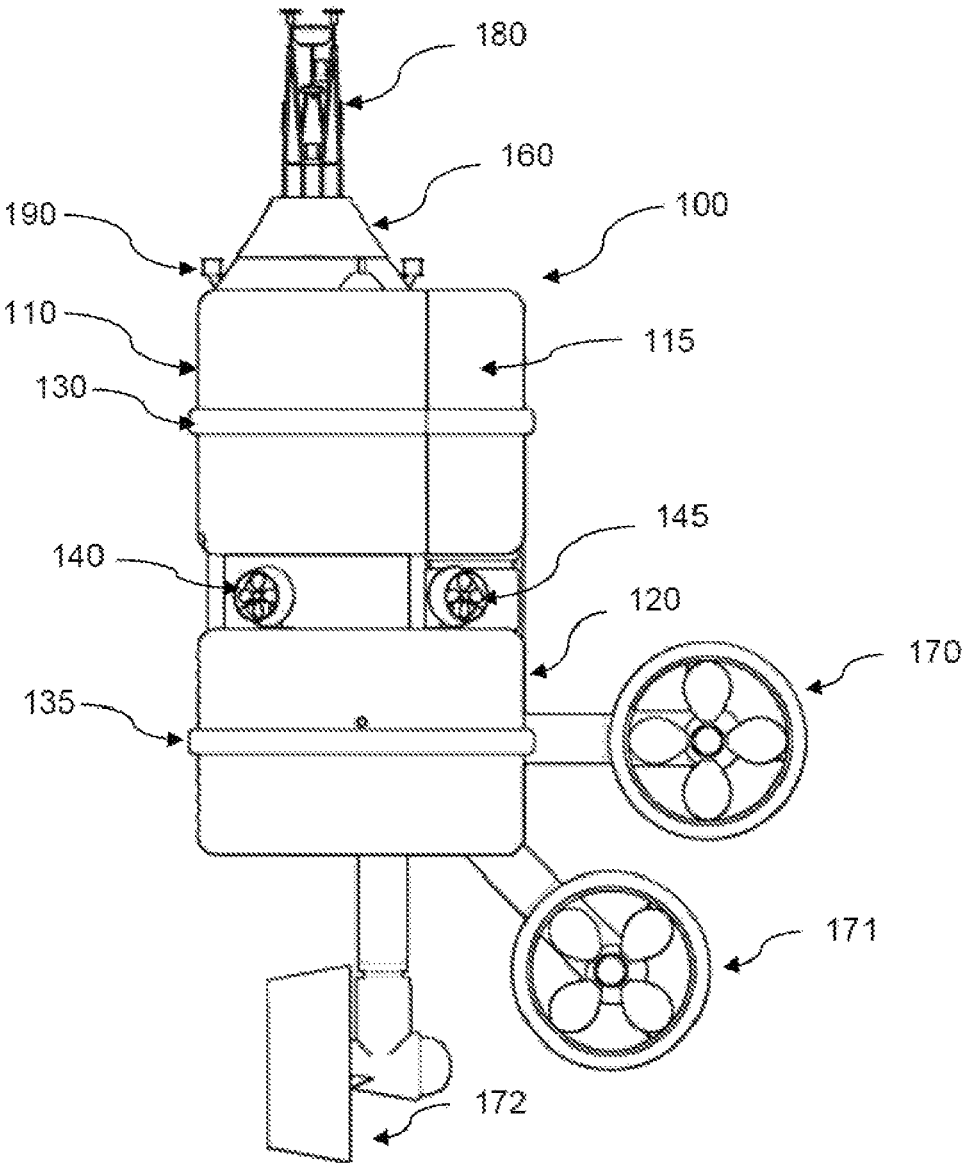
FIG. 1 shows a front view of a remote-controllable underwater device according to an embodiment of the present invention.

Accordingly, the present invention in a first embodiment provides a remote controllable underwater device for manoeuvring an external object, the device comprising at least one housing, a connection unit provided on the housing for rigidly attaching to an external object to be manoeuvred, at least one propeller for moving the device and to enable push or pull of the external object to be manoeuvred, an antenna for remote communication of the device from a remote control unit, at least one sensor for path tracking and safe positioning of the device and the external object to be manoeuvred, and a power source for providing power to the connection unit, the propeller, the antenna, and the sensor.

According to the present invention, the housing is designed to be watertight for underwater operations. The housing includes a fender to protect the device from external impact or collision. Advantageously, the manoeuvring device comprises a light source, cameras and sonars for visibility and underwater operation.

According to the present invention, internal equipment weights such as batteries are placed on a travelling and braking arrangement inside the housing to allow internal shifting of weights, and to keep the device upright in the water during swing-up of the propellers. Additional methods of keeping the device upright includes swing out of an external buoyancy foam.

According to the present invention, the connection unit is used for attaching the device to the external object to be manoeuvred such as ships, other floating vessels, etc. by robotic arms or linear actuators or combination thereof to ship hull using electro-magnets or to specially designed connection points on ships hull. The robotic arms or linear actuators are remotely controlled or autonomously connect using various sensors, to the external object to be manoeuvred, for pushing or pulling. The electro-magnets or hull connectors on the ends of the robotic arms or linear actuators are fitted on ball joints to allow freedom of movement when attaching to varying curvatures on the vessel to be manoeuvred.

According to the present invention, at least one propeller is used to move the device in proximity of the external object and provide enough force to push or pull the external object to be manoeuvred such as ships, other floating vessels, etc. Separate propellers may be used for moving the device and push or pull of the external objects. The propellers are either fixed, azimuthing, swing-up, or combination thereof which provides thrust in all directions, and can be swing-up to a horizontal position for thrust in the forward and aft directions which reduces the radial forces on the attachments to the vessel hull. Advantageously, the propeller configured to swing below a keel of the vessel and rotatably adapted for generating a thrust below the keel for manoeuvring the vessel to the predetermined direction. The horizontal position of the propellers also allows navigation of the device in shallow waters. Advantageously, multiple propeller may be used for moving the device and pushing or pulling heavy weight external floating objects. The propellers are capable of pushing or pulling heavy external objects.

According to the present invention, transmission of instructions between the device and the remote control unit is through long range Wi-Fi (LR Wi-Fi) signals or acoustic or broadband radio or combination thereof to allow high speed data transfer. Advantageously, the shipboard pilot can control and monitor the device and movement of the ship to be positioned. Alternatively, if the device is control and monitored from the remote location the remote control unit data can be viewed by the shipboard pilot.

According to the present invention, the LR Wi-Fi antenna and broadband radio antenna is placed on a self-righting antenna buoy which is adapted on the housing and is allowed to float on the water surface when the device has to dive below the water surface. The self-righting antenna buoy remains tethered to the device when the device is below the water surface and is winched into the housing when the device surfaces GPS positioning antenna are also placed on the self-righting buoy antenna.

According to the present invention, the GPS, an inertial navigation unit, the sensors, speed log, and sonar transducers adapted on the housing of the device are used for path tracking and safe positioning of the ship based on the instructions received from the controller of the remote control unit. The communication between the device and the remote control is secured by encryption, point to point communication and frequency hopping on multiple channels.

According to the present invention, the remote control unit comprises a controller, a display unit, an input unit, and a communication means. The controller is configured to receive data such as path from the device through the communication means and display on the display unit, receive instructions from the input unit and transmit it to the device to operate based on the instructions.

According to the present invention, the power source comprises a pack of chargeable battery or generator or combination thereof to provide power to the connection unit, the propeller, the communication unit, and the sensors. Advantageously, the power source may be provided from an external device through a cable such as electric supply from a remote power generation unit.

According to the present invention, the device is designed to be positively buoyant so that it can float to the surface in case of any emergency.

According to the present invention, the device may be used for underwater surveys in port such as ship hull, propeller condition, jetty pile inspection, underwater obstruction and bottom, ship grounding, drifting object recovery, oil spill recovery, etc.

According to the present invention, the device may operate based on instructions configured in controller of the remote control unit to autonomously follow pre-defined routes and maintain depth below the surface, scan vessel shell expansion plans and generate an image of the side shell plate welding seams for homing onto hull, scan vessel construction plans and calculate hull strength and curvature at the touchdown location on vessel hull, provide early warning and evasive manoeuvring action to avoid collision with surface objects, provide early grounding warning and thruster automatic swing-up if the echo sounder detects shallow depth, collect health status of various on-board equipment and provide diagnostics as well as take necessary action, and scan vessel sea trial data and provide information to the pilot on the recommended vessel speed and telegraph position according to the manoeuvring requirements.

For an example, when an external floating object such as ship or barge needs to be manoeuvred in the harbour, the device stationed either at the harbour or ship is launched into the water. The device is now guided to move in proximity to the ship through pre-programming as well as a remote control unit. The remote control unit provides instructions to the device based on the data received through the sensors, camera, and other means of collecting the data adapted on the housing of the device. Once the device is brought in close proximity with the ship, the device is attached to the hull of the ship through the connection unit. The main propellers mounted on the housing of the device are arranged such that the propeller is below a keel of the ship and are activated to provide enough thrust in requisite direction to push or pull the ship. The remote control unit monitors and controls the functioning of the device until the ship is positioned in the harbour. Alternatively, the remote control unit comprises of a controller which can be adapted to automatically control and monitor the device and position the ship safely in the harbour.

For another example, when an external floating object such as a ship or a barge needs to the manoeuvred near other fixed objects such as a lock gate, or a shipping canal, or a offshore oil platform, the device is used to position and manoeuvre the floating object as desired. The device is attached to the hull of the floating body through the connection unit, and the main propellers mounted on the housing of the device are arranged such that the propeller is below the keel of the floating object and are activated to provide enough thrust in requisite direction to push or pull the floating object. The positioning of the floating object can be monitored and controlled, by the remote control device, either manually, or autonomously.

Alternatively, the device can be operated manually.

Accordingly, the present invention in a second embodiment provides a remote controllable underwater device for manoeuvring an external object, the device comprising at least one housing, a connection unit provided on the housing for rigidly attaching to an external object to be manoeuvred, at least one propeller for moving the device and to enable push or pull of the external object to be manoeuvred, at least one sensor for path tracking and safe positioning of the device and the external object to be manoeuvred, an antenna for remote communication of the device from a remote control unit, a controller connected to the propeller, the sensor, and the antenna; and a power source for providing power to the connection unit, the propeller, the sensor, the antenna, and the controller.

According to the present invention, the controller of the device is configured receive data from the sensors and transmit to the remote control unit through the antenna. The controller is further configured to receive instructions from the remote control unit and operate the propeller to position the external object at desired location.

Accordingly, the present invention in third embodiment provides a system for manoeuvring a vessel, the system comprising at least one remote-controllable underwater device for manoeuvring the vessel; and a remote control unit for control and monitoring of the device and for manoeuvring the vessel, the controlling and monitoring includes moving the device in proximity to the vessel; attaching the device to the vessel through a connection unit of the device; and positioning the vessel to the desired location based on the input received.

Accordingly, the present invention in fourth embodiment provides a method for manoeuvring a vessel, the method including the steps of guiding a remote-controllable underwater device, through a remote control unit, in proximity of an external object to be manoeuvred; attaching the device, through a connection unit, to the external object; providing enough thrust, through propeller, to push or pull the external object in required direction; and positioning the external object by the device according to the instructions received from the remote control unit.

The subject matter is now described with reference to the drawings, wherein like reference numerals are used to refer to like elements throughout. In the following description, for purpose of explanation, numerous specific details are set forth in order to provide a thorough understanding of the claimed subject matter. It may be evident however, that such matter can be practiced with these specific details. In other instances, well-known structures as shown in diagram form in order to facilitate describing the invention.

Referring FIG. 1 shows a front view of a remote-controllable underwater device(100) for manoeuvring a vessel according to an embodiment of the present invention, the device (100) comprising a housing (110, 120), a fender (130, 135) adapted on the housing (110, 120), a connection unit (not shown) for rigidly attaching the device (100) to the vessel, a plurality of device propeller (140, 145) for moving the device (100), an antenna (180) for communication of device (100) with the remote control unit (not shown), a plurality of sensors (190) for control and monitoring of the device (100), and plurality of main propeller (170, 171, 172) for providing enough thrust to push or pull the vessel (not shown) attached to the device (100).

As shown in FIG. 1, the housing (110, 120) comprises two connected compartments, the lower compartment (120) having main propeller (170, 171, 172) mounted on it with an option to store various equipment, and the upper compartment (110) containing the power source with other supporting equipment. The power source (not shown) comprises of a pack of chargeable batteries or a generator or combination thereof to provide power to different components of the device (100) that requires power source for operation. Advantageously, the power source (not shown) may be provided from an external device through a cable such as electric supply from a remote power generation unit.

As shown in FIG. 1, the housing (110) includes a swingout external buoyancy arrangement (115) to keep the device (100) upright in water during the operation.

As shown in FIG. 1, the plurality of device propeller (140, 145) are additionally used for diving and surfacing of the device (100).

As shown in FIG. 1, a self-righting antenna buoy (160) holds the communication antenna (180) which positions on the surface of the water when the device dives into the water.

As shown in FIG. 1, the sensors (190) additionally captures various data related to the vessel that need to be manoeuvred and positioned in a harbour such as relative distance between the vessel and the device (100), hull condition, etc.

Figure 2:
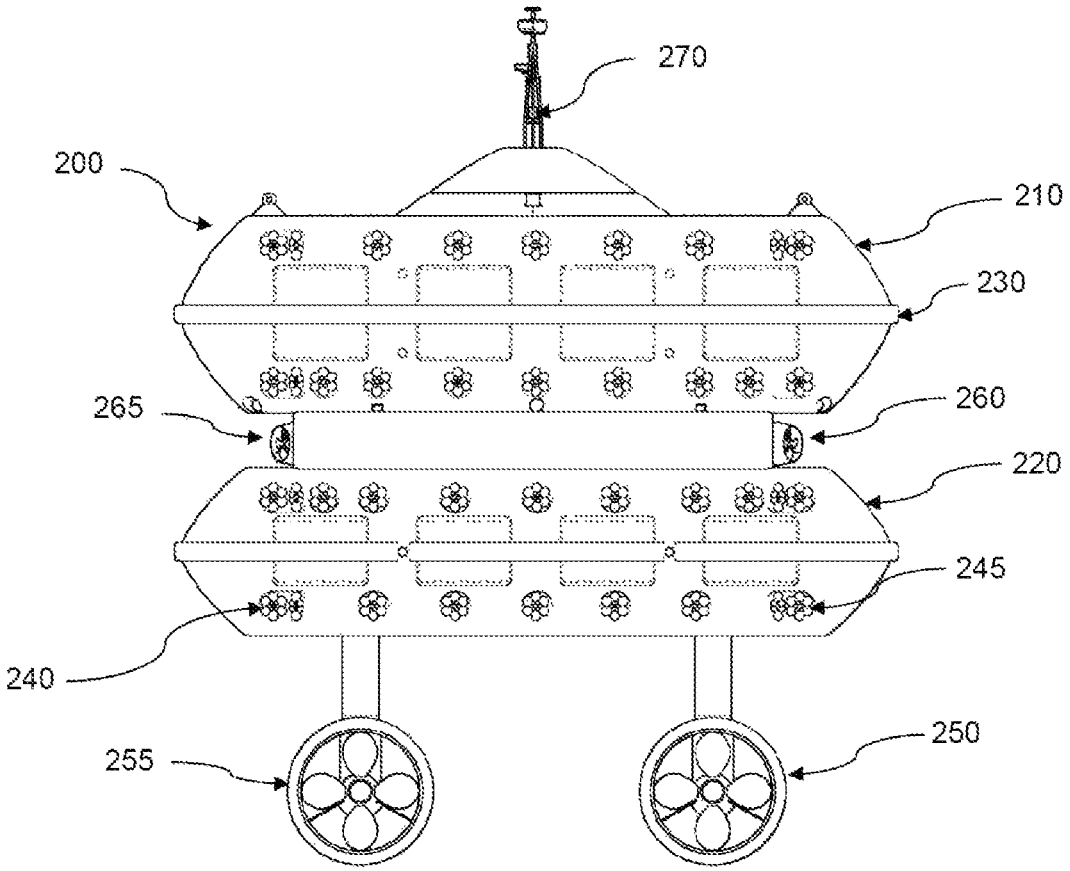
FIG. 2 shows a side view of a remote-controllable underwater device according to an embodiment of the present invention.

Referring FIG. 2 shows a side view of a remote-controllable underwater device(200) for manoeuvring a vessel according to the present invention, the device (200) comprising housings (210, 220), a fender (230), a plurality of electro-magnets (240, 245) for connecting to an external object, a plurality of main propellers (250, 255) either fixed, azimuthing, swing-up, or combination thereof which provides thrust in all directions to push or pull the vessel, a plurality of device propeller (260, 265) placed inside vertical tunnels for moving, diving, and surfacing of the device (200), a navigation light mast for surface navigation (270), and linear actuators (not shown) attached to the electromagnets that allow the electro-magnets to extend outward and attach to external object.

As shown in FIG. 2, the main propeller (250, 255) are used to provide enough force to push or pull the external objects to be towed such as ships, other floating objects, etc. Advantageously, the main propeller (250, 255) are capable of pushing or pulling heavy weight external floating objects.

Figure 3:
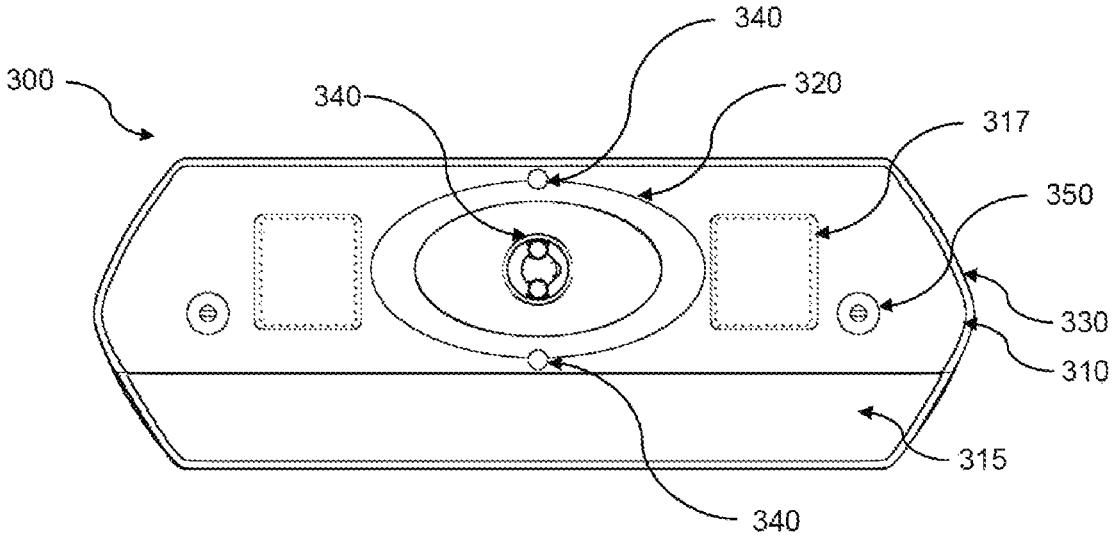
FIG. 3 shows a top view of a remote-controllable underwater device according to an embodiment of the present invention.

Referring FIG. 3 shows a top view of a remote-controllable underwater device (300) for manoeuvring a vessel according to the present invention, the device (300) comprising housings (310), swingout external buoyancy arrangement (315) to keep the device (300) upright in water during the operation, watertight access hatches (317) for access to the internal equipment, a self-righting antenna buoy (320) holding an antenna, a fender (330) adapted on the housing (310) to reduce impact with any external object, navigation side lights(340) showing port and starboard sides for surface navigation, lifting lugs (350) for launching and recovery of the device, cameras (not shown), and sonars (not shown) for visibility and under water operation of the device (300).

Figure 4:
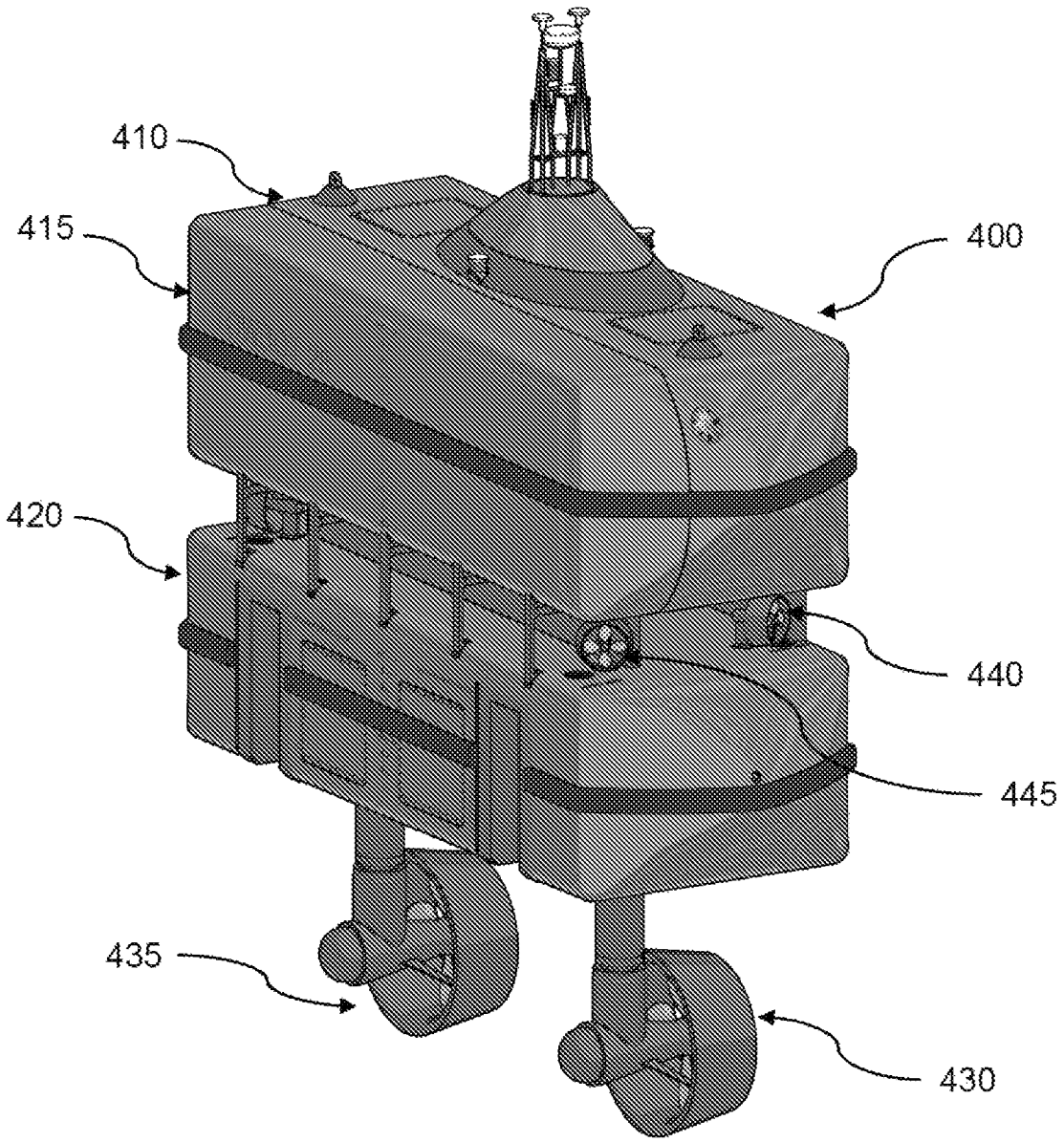
FIG. 4 shows an isometric view of a remote-controllable underwater device according to an embodiment of the present invention.

Referring FIG. 4 shows an isometric view of a remote-controllable underwater device (400) according to the present invention, the device (400) comprising housings (410, 420), a plurality of electro-magnets (not shown) for connecting to an external object, a plurality of main propeller (430, 435) either fixed, azimuthing, swing-up, or combination thereof which provides thrust in all directions, a plurality of device propeller (440, 445) placed inside vertical tunnels for moving, diving, and surfacing of the device (400), and linear actuators (not shown) attached to the electromagnets that allow the electro-magnets to extend outward and attach to external object.

As shown in FIG. 4, the housing (410) includes a swingout external buoyancy arrangement (415) to keep the device (400) upright in water during the operation.

Figure 5:
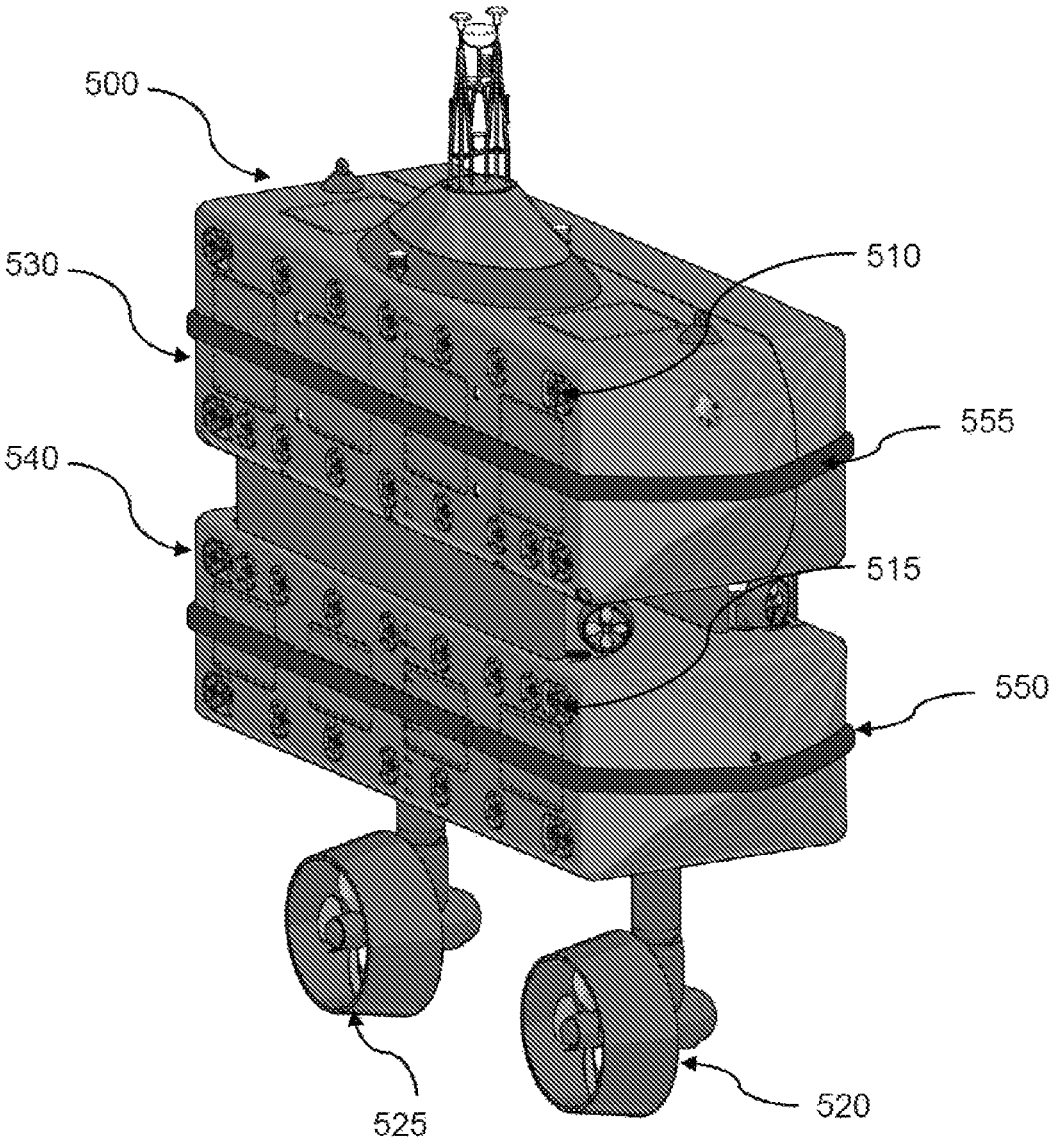
FIG. 5 shows an isometric view of a remote-controllable underwater device according to an embodiment of the present invention.

Referring FIG. 5 shows an isometric view of a remote-controllable underwater device (500) according to the present invention, the device (500) comprising housings (530, 540), a plurality of electro-magnets (510, 515) for connecting to an external object to be manoeuvred, linear actuators (not shown) attached to the electro-magnets (510, 515) to allow the electro-magnets (510, 515) to extend outward and attach to external object, a plurality of main propeller (520, 525) either fixed, azimuthing, swing-up, or combination thereof provides thrust in all directions, a plurality of device propeller (not shown) for manoeuvring of the device (500), at least one sensor (not shown) for path tracking and safe positioning of the external object, a remote control unit (not shown) for communicating with the device (500), at least one camera (notshown), a light source (not shown),and sonars (not shown)for visibility and path tracking, and a power source (not shown) for providing power to all the elements.

As shown in FIG. 5, the housing (530, 540) comprises compartments for storing equipments (not shown). Advantageously, rubber fenders (550, 555) may be placed outside the housing (530, 540) to cushion any possible impact with the ship when the electro-magnets (510, 515) connect to the external object.

As shown in FIG. 5, the device propeller (not shown) and main propulsion thrusters (520, 525) are capable of providing enough thrust as required. Advantageously, the device propeller (not shown) and main propeller (520, 525) can provide thrust in any directions, capable of pushing/pulling heavy external objects; additionally, water jets or other devices may be used for providing thrust.

Figure 6:
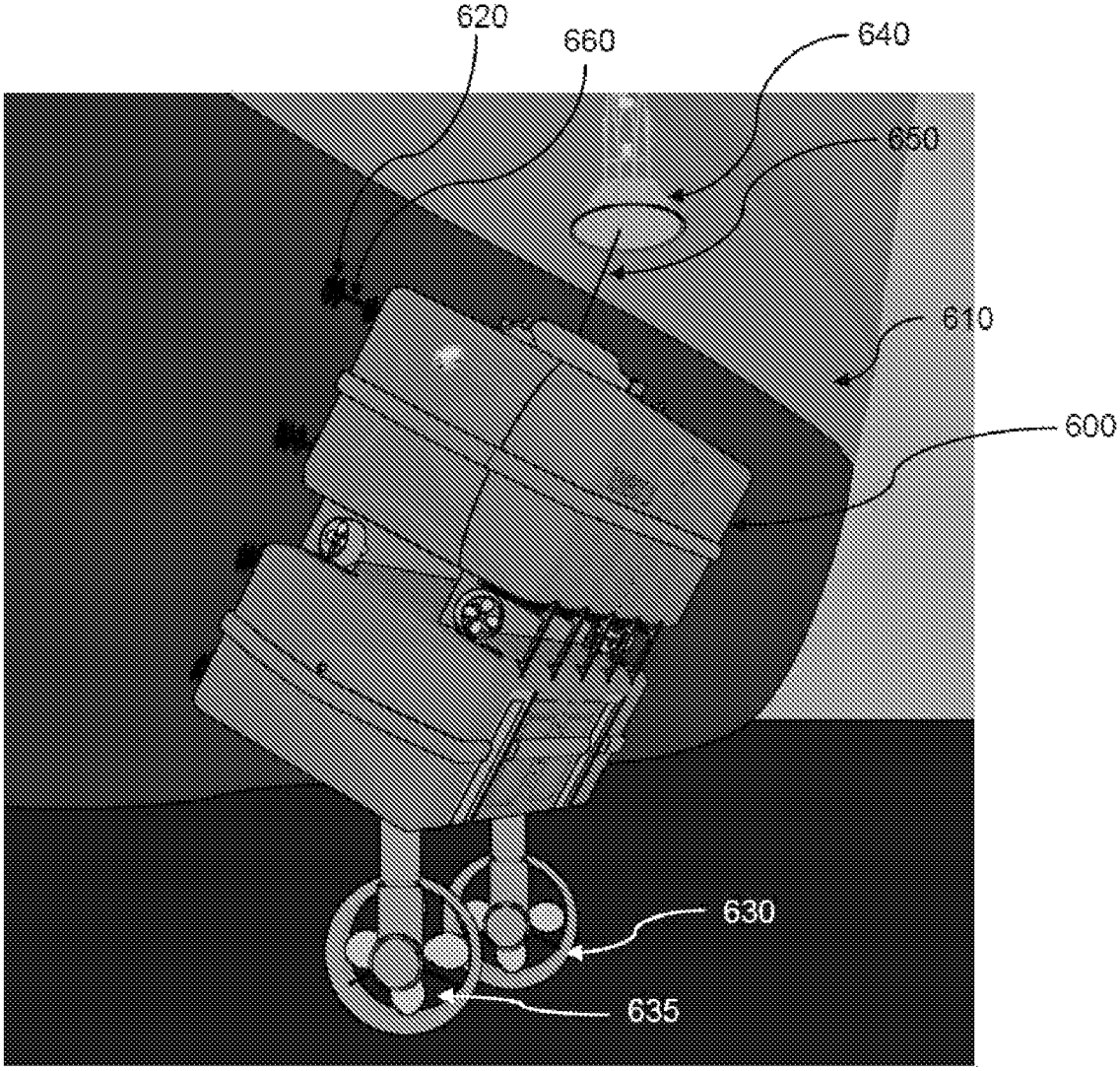
FIG. 6 shows a remote-controllable underwater device attached to a ship according to an embodiment of the present invention.

Referring FIG. 6 shows a remote-controllable underwater device (600) attached to a ship (610) according to the present invention, the electro-magnets (620) of the device (600) gets attached to the ship (610) with the help of the linear actuators (660) which extends outwards when attaching to the ship (610), and main propeller (630, 635) either fixed, azimuthing, swing-up, or combination thereof provides thrust in all directions for the movement of the ship (610), to facilitate proper positioning of the ship (610).

As shown in FIG. 6, the self-righting antenna buoy (640) is detached from the device (600) and floats on the water surface, tethered to the device (600) with a communication cable (650). The sensors (not shown) are used for path tracking and proper positioning of the ship (610).

Figure 7:
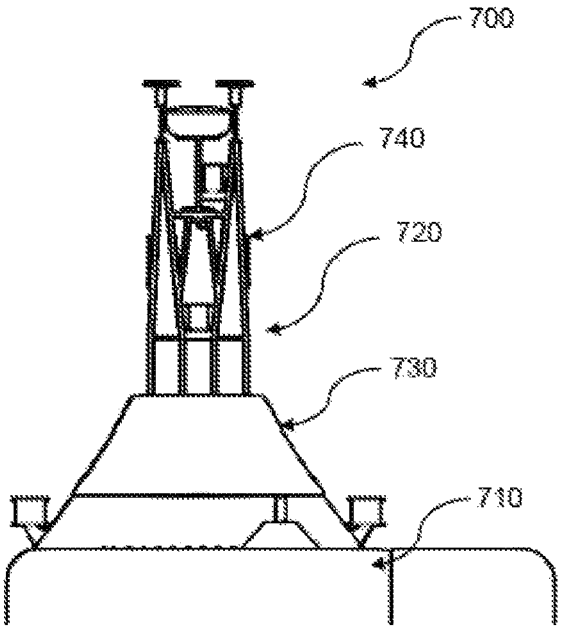
FIG. 7 shows a self-righting antenna buoy for surface communication, positioning and collision avoidance, adapted on a remote-controllable underwater device according to an embodiment of the present invention.

Referring FIG. 7 shows a self-righting antenna buoy (720) for surface communication, positioning and collision avoidance, adapted on a remote controllable under water device (700) according to the present invention. The self-righting antenna buoy (720) is housed on the upper housing (710) of the device (700). The self-righting antenna buoy (720) includes an antenna (740) for communication and a flotation device (730) allowing the self-righting antenna buoy (720) to float on the water surface when the device (700) dives below the water surface. The self-righting antenna buoy (720) configured for communication and positioning. The self-righting antenna buoy (720) remains tethered to the manoeuvring device when the manoeuvring device is below the water surface, and is winched into the upper housing (710) when the manoeuvring device surfaces.

Figure 8:
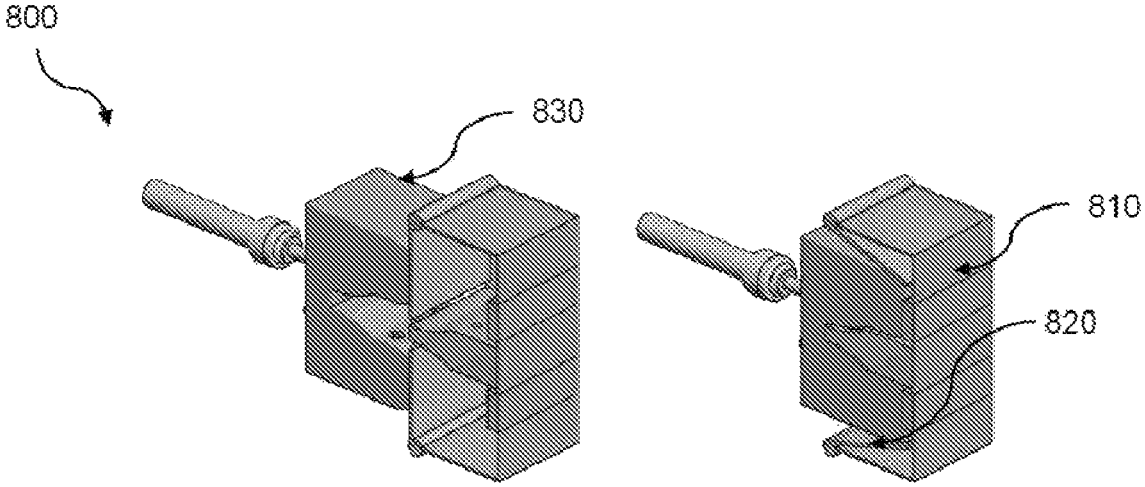
FIG. 8 shows a connection point on the ship hull for attaching a remote-controllable underwater device according to an embodiment of present invention.

Referring FIG. 8 shows an optional specially designed connection point (800) on the ship hull (810) for attaching the remote-controllable underwater device (not shown). The connection point (800) allows for load transfer directly to the ship structure, reducing the need for multiple smaller magnets to transfer the load. The hull connection point (800) is recessed into the ship hull (810), with opening covers (820) to reduce drag. No power source is required at the hull connection box. The device (not shown) is fitted with a coupling (830) that opens the cover of the hull connection and bolts itself directly to the hull. This may be installed on new buildings or at the next drydock.

Figure 9:
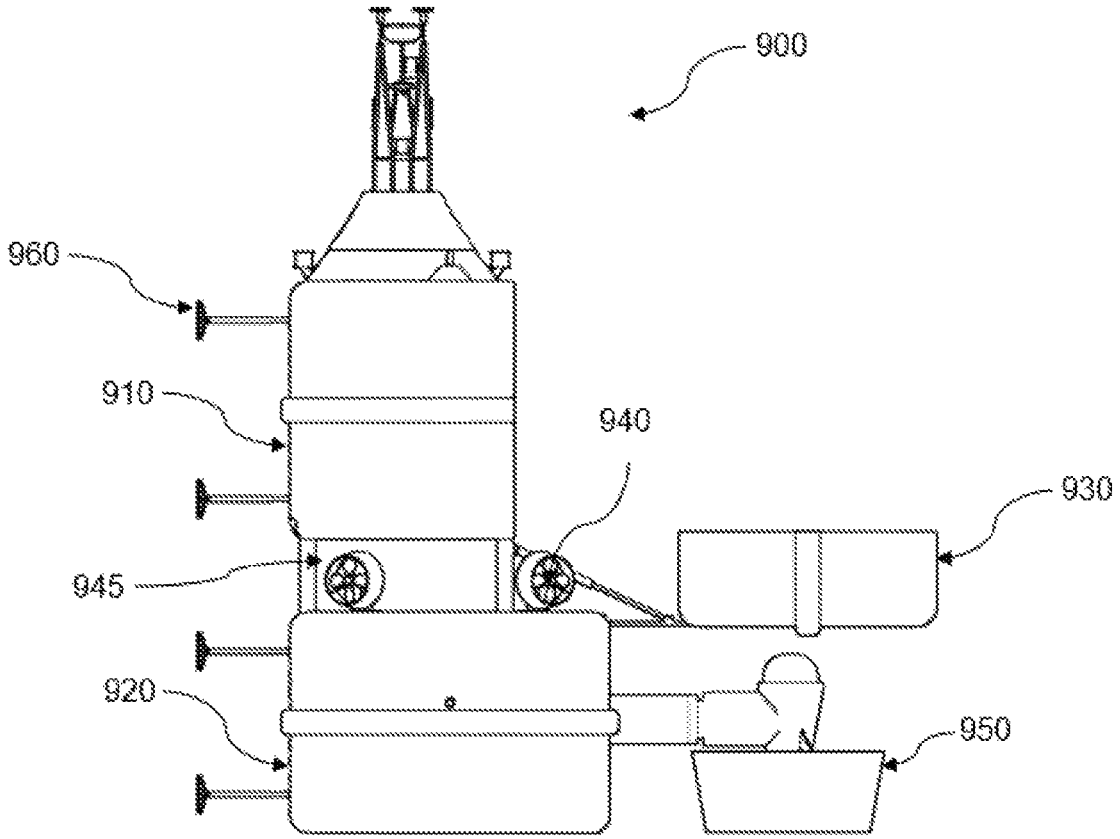
FIG. 9 shows a remote-controllable underwater device with swing out external buoyancy arrangement according to an embodiment of the present invention.

Referring FIG. 9 shows a remote-controllable underwater device (900) with swingout buoyancy foam (930) according to an embodiment of the present invention, the device (900) comprising a housing (910, 920), a device propeller (940, 945) for moving the device (900), electro-magnets (960) for attaching to the vessel to be manoeuvred, a main propeller (950) either fixed, azimuthing, swing-up, or combination thereof for pushing or pulling the vessel, and a swingout buoyancy foam (930) extended outward to keep the device (900) upright in water.

Figure 10:
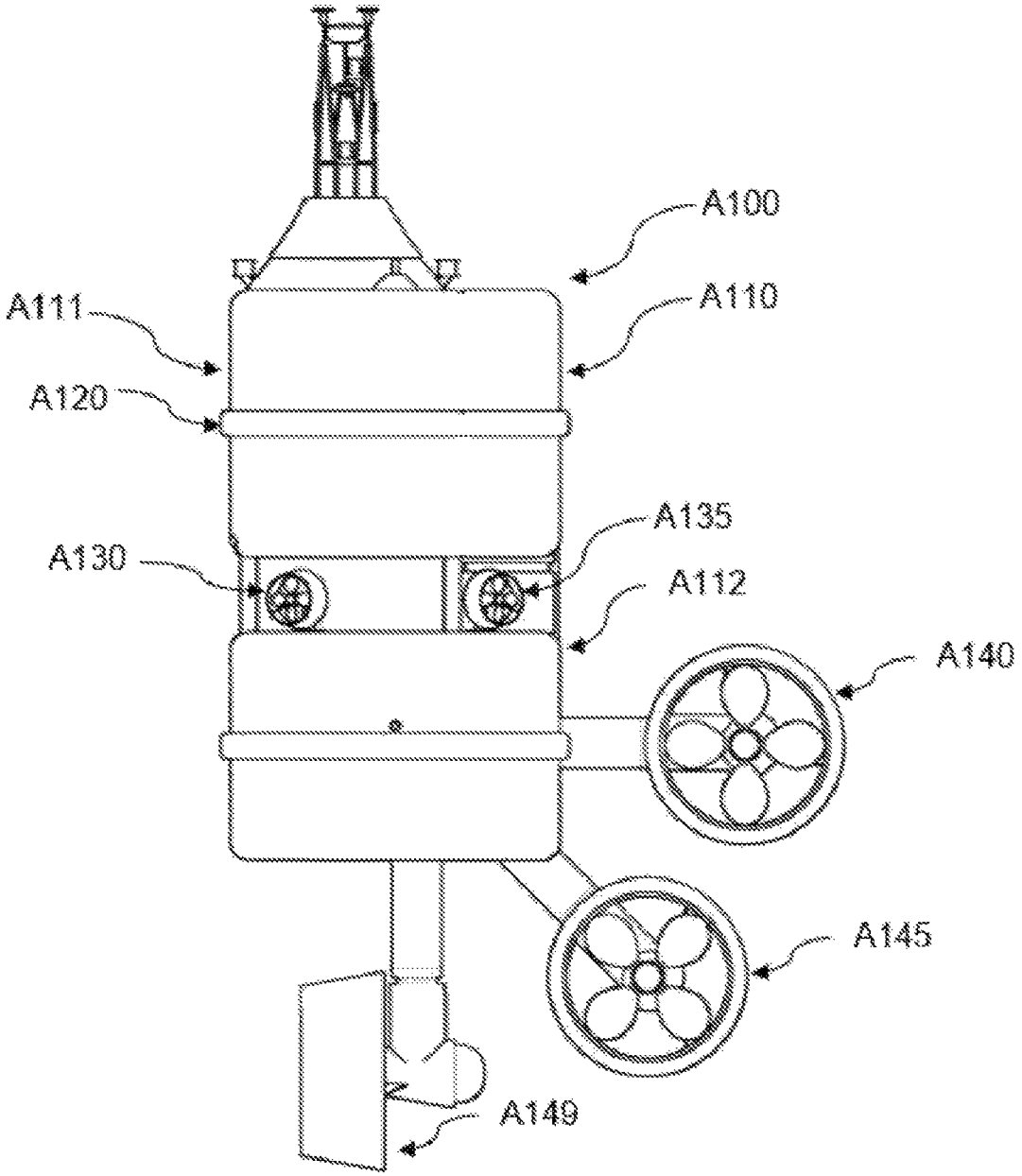
FIG. 10 shows a remote-controllable underwater device with device propeller according to an embodiment of the present invention.

Referring FIG. 10 shows a remote-controllable underwater device (A 100) with device propeller (A 130, A 135) according to the present invention, the device (A100) comprises a housing (A110), the housing includes an upper compartment (A111) and a lower compartment (A112); a fender (A120); a device propulsion thruster (A130, A135) for moving the device, and a main propulsion thruster (A140, A145, A149) for pushing and pulling the vessel to position it on a harbour.

The foregoing description of the invention has been set merely to illustrate the invention and is not intended to be limiting. Since modifications of the disclosed embodiments incorporating the substance of the invention may occur to person skilled in the art, the invention should be construed to include everything within the scope of the disclosure.

The invention claimed is:

1. A remote-controllable underwater device for manoeuvring a vessel, the device comprising:

a housing;

a connection unit provided on the housing for rigidly attaching underwater to one side of the vessel to be manoeuvred, wherein the connection unit includes any or a combination of at least one robotic arm and at least one linear actuator, said any or a combination of the at least one robotic arm and the at least one linear actuator extending outwards and adjusting to curvature of the vessel when attached with the vessel;

at least one propeller mounted on the housing for moving the attached vessel;

an antenna for communication with the device from a remote control unit;

at least one sensor for path tracking and positioning of the device and the vessel; and a power source for providing power to the connection unit, the propeller, the antenna, and the sensor.

2. The remote-controllable underwater device as claimed in claim 1, wherein the main propeller thruster for manoeuvring the vessel is either fixed, azimuthing, swing-up, or combination thereof which provides thrust in all the direction for manoeuvring the vessel.

3. The remote-controllable underwater device as claimed in claim 1, wherein the propeller swings below a keel of the vessel and rotatably adapted for generating a thrust below the keel for manoeuvring the vessel to the predetermined direction.

4. The remote-controllable underwater device as claimed in claim 1, wherein the housing includes a swingout external buoyancy arrangement or a mechanism for internal shifting of weights, to keep the device upright in the water.

5. The remote-controllable underwater device as claimed in claim 1, wherein the housing includes a fender to protect the device from external impact.

6. The remote-controllable underwater device as claimed in claim 1, wherein the housing includes an upper section for storing a power source and a lower section for storing equipment.

7. The remote-controllable underwater device as claimed in claim 1, wherein the propeller includes a main propeller for manoeuvring the vessel attached to the connection unit and a device propulsion thruster for manoeuvring the device.

8. The remote-controllable underwater device as claimed in claim 7, wherein the device propulsion thruster includes a thruster for diving and surfacing of the device.

9. The remote-controllable underwater device as claimed in claim 1, wherein any or a combination of the at least one robotic arm and the at least one linear actuator is fitted with electro-magnets or designed connections for attaching the vessel to be manoeuvred.

10. The remote-controllable underwater device as claimed in claim 1, wherein the power source includes a pack of chargeable batteries or a generator or an electric supply though cable or combination thereof.

11. A system for manoeuvring a vessel, the system comprising:

at least one remote-controllable underwater device for manoeuvring the vessel; and a remote control unit for controlling and monitoring of the device and for manoeuvring the vessel, the controlling and monitoring includes moving the device in proximity to the vessel, attaching the device to the vessel through a connection unit of the device, and positioning the vessel to the desired location based on the input received, wherein the connection unit includes any or a combination of at least one robotic arm and at least one linear actuator, said any or a combination of the at least one robotic arm and the at least one linear actuator extending outwards and adjusting to curvature of the vessel when attached with the vessel.

12. The system for manoeuvring the vessel as claimed in claim 11, wherein the remote control unit is a centralized system for managing and control of the device through at least one location.

13. A method for manoeuvring a vessel, the method including the steps of:

guiding a remote-controllable underwater device, through a remote control unit, in proximity of an external object to be manoeuvred;

attaching the device, through a connection unit, to the external object, wherein the connection unit includes any or a combination of at least one robotic arm and at least one linear actuator, said any or a combination of the at least one robotic arm and the at least one linear actuator extending outwards and adjusting to curvature of the object when attached with the object;

providing enough thrust, through propeller, to push or pull the external object in required direction; and positioning the external object by the device according to the instructions received from the remote control unit.

* * * * *